US007731536B2

(12) United States Patent
Okayasu

(10) Patent No.: US 7,731,536 B2
(45) Date of Patent: Jun. 8, 2010

(54) SHIELDED CONNECTOR

(75) Inventor: Yasushi Okayasu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 151 days.

(21) Appl. No.: 11/899,794

(22) Filed: Sep. 7, 2007

(65) Prior Publication Data

US 2009/0035993 A1 Feb. 5, 2009

(30) Foreign Application Priority Data

Sep. 7, 2006 (JP) ..... 2006-242841

(51) Int. Cl.
*H01R 9/03* (2006.01)

(52) U.S. Cl. ..... 439/607.51; 439/98

(58) Field of Classification Search ..... 439/98, 439/99, 607.41, 607.5, 607.51
See application file for complete search history.

(56) References Cited

U.S. PATENT DOCUMENTS 5,281,170 A * 1/1994 Murphy ..... 439/607.5
5,429,529 A * 7/1995 Hashizawa et al. ..... 439/607.5
5,725,391 A * 3/1998 Masuda et al. ..... 439/582
5,965,847 A * 10/1999 Tanaka et al. ..... 174/84 R
6,039,605 A * 3/2000 Tanaka ..... 439/607.44
6,270,377 B1 * 8/2001 Miyazaki et al. ..... 439/607.41
6,464,538 B2 * 10/2002 Miyazaki et al. ..... 439/607.44
6,648,690 B2 * 11/2003 Saito et al. ..... 439/607.44
6,887,106 B2 * 5/2005 Noguchi et al. ..... 439/607.56
7,044,756 B1 * 5/2006 Asakura et al. ..... 439/98
7,344,413 B2 * 3/2008 Nishida ..... 439/607.41
2009/0035993 A1 * 2/2009 Okayasu ..... 439/610

FOREIGN PATENT DOCUMENTS

JP 11-40273 12/1999

* cited by examiner

*Primary Examiner*—James Harvey
(74) *Attorney, Agent, or Firm*—Gerald E. Hespos; Anthony J. Casella

(57) ABSTRACT

A crimp ring (14) is mounted on a braided wire (13) of a shielded cable (12). On the other hand, a shielding shell (20) connectable with a large diameter portion (14*b*) of the crimp ring (14) is mounted in a housing (8). Entire touching portions (35) are formed at both upper and lower surfaces of the shielding shell (20) by being bent inward to form mountain-shaped resilient contact pieces (36) that can resiliently contact the large diameter portion (14*b*) and then being folded back outward near the rear edge of the shielding shell (20). Displacement restricting portions (40) are arranged between the touching portions (35) adjacent in width direction to protect the other touching portions (35) from the interference of the shielded cable (12) being inserted or withdrawn.

7 Claims, 11 Drawing Sheets

SHIELDED CONNECTOR

BACKGROUND OF THE INVENTION

1. Field of the Invention

The invention relates to a shielded connector.

2. Description of the Related Art

Japanese Unexamined Patent Publication No. H11-40273 discloses a conventional shielded connector with an electrical contact formed in a shielding shell. The contact can resiliently contact a shielding portion to achieve reliable and easy connection of a shielding portion of a shielded cable and the shielding shell.

The shielding shell of the above-described connector is formed by bending an electrically conductive metal plate into a cylindrical shape, and four spring pieces project out in the longitudinal direction at regular angular intervals from the rear edge of the shielding shell. The spring pieces are folded in at the longitudinal projecting ends and can deform resiliently in radial directions. However, external matter can interfere with outwardly projecting parts of the spring pieces. Thus, the spring pieces easily can be damaged. Accordingly, a contact state of the shielded cable and the shielding portion is likely to be unstable.

The invention was developed in view of the above situation and an object thereof is to provide a shielded connector for protecting a touching portion of a shielding shell from contact with external matter.

SUMMARY OF THE INVENTION

The invention relates to a shielded connector with at least one terminal fitting to be connected with an end of a core of a shielded cable. The shielded connector also has a housing for accommodating the terminal fitting, and a shielding shell that can be mounted to the housing for contacting a shielding portion of the shielded cable. The shielding shell defines a tubular shape surrounding the outer side of the shielding portion and has at least one touching portion that can resiliently contact the shielding portion. The touching portion is within the length of the tubular part of the shielding shell without projecting in the lengthwise direction from an end of the shielding shell. Accordingly, the touching portion will not be deformed by contact with external matter and the shielding shell can be shorter.

The touching portion preferably is formed by making at least two cuts or recesses along the lengthwise direction from a position at or near the end edge of the shielding shell. A part between the two cuts or recesses projects inward of the shielding shell for resiliently contacting the shielding portion and is folded back outward near the end edge of the shielding shell.

A stopper edge preferably is formed at the folded end of the touching portion and contacts at lest one locking step formed on the housing when the shielding shell is mounted to the housing for preventing further movement of the shielding shell.

The folded-back edge of the touching portion preferably is the stopper edge and contacts the locking step of the housing when the shielding shell is mounted to the housing. Thus, the mount position of the shielding shell can be determined.

The shielding portion preferably is formed by a crimp ring to be fastened to a shield layer exposed from the shielded cable and has a portion with a larger diameter than the shielded cable.

The touching portion preferably is formed by making at least two slits or recesses along a lengthwise direction in a lengthwise intermediate part of the shielding shell and can resiliently contact the crimp ring. A part between the two slits or recesses is held substantially flush with the outer surface of the shielding shell. Accordingly, a chance of contact with external matter can be reduced further, and deformation is less likely. Further, the yield of the shielding shell can be improved.

At least one displacement restricting portion preferably projects from the shielding shell and/or the housing. The leading end of the displacement restricting portion is at a lateral side of the shielding portion of the shielded cable for restricting an off-center displacement of the shielded cable. The displacement restricting portion contacts the shielded cable in the case of an off-center displacement of the shielded cable being inserted into the shielding shell or in the case of the shake of the shielded cable after the insertion. Therefore a displacement from a proper inserting direction can be avoided.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
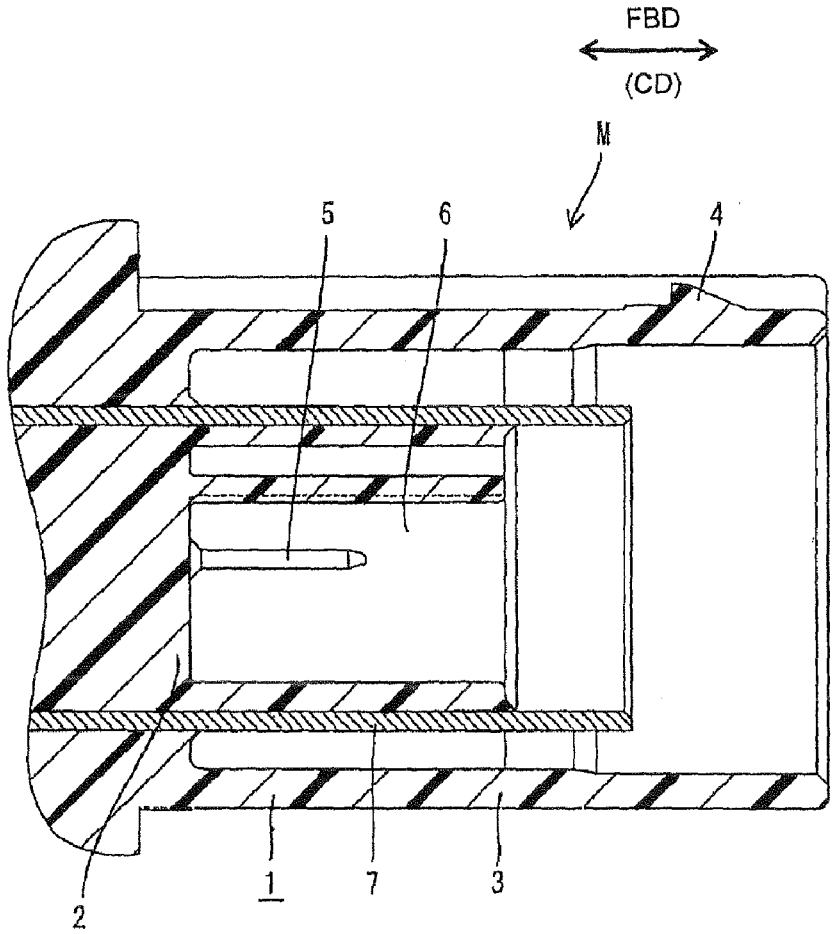
FIG. 1 is a section of a first embodiment of a male connector.
Figure 2:
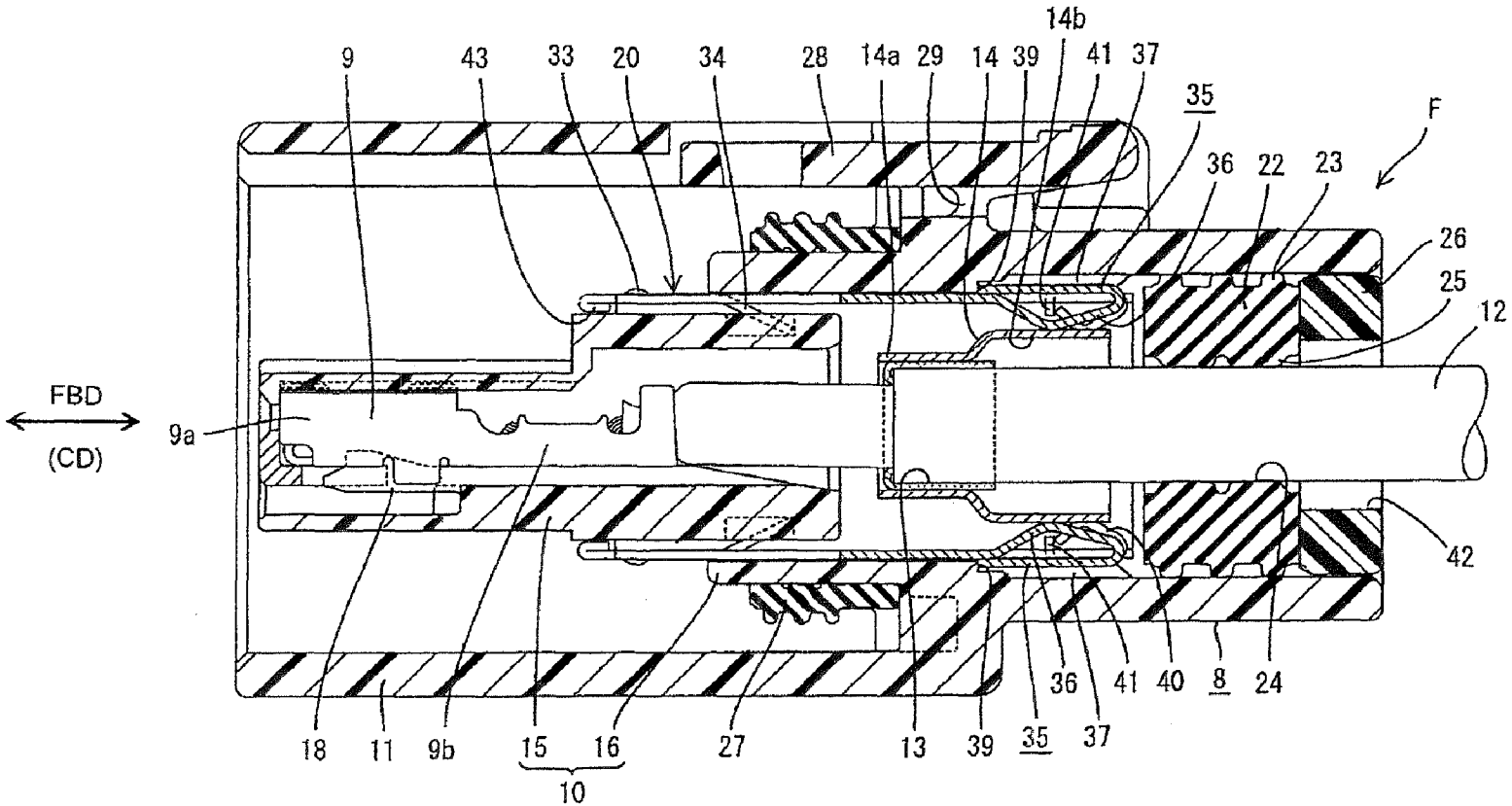
FIG. 2 is a section of a first embodiment of a female connector.
Figure 3:
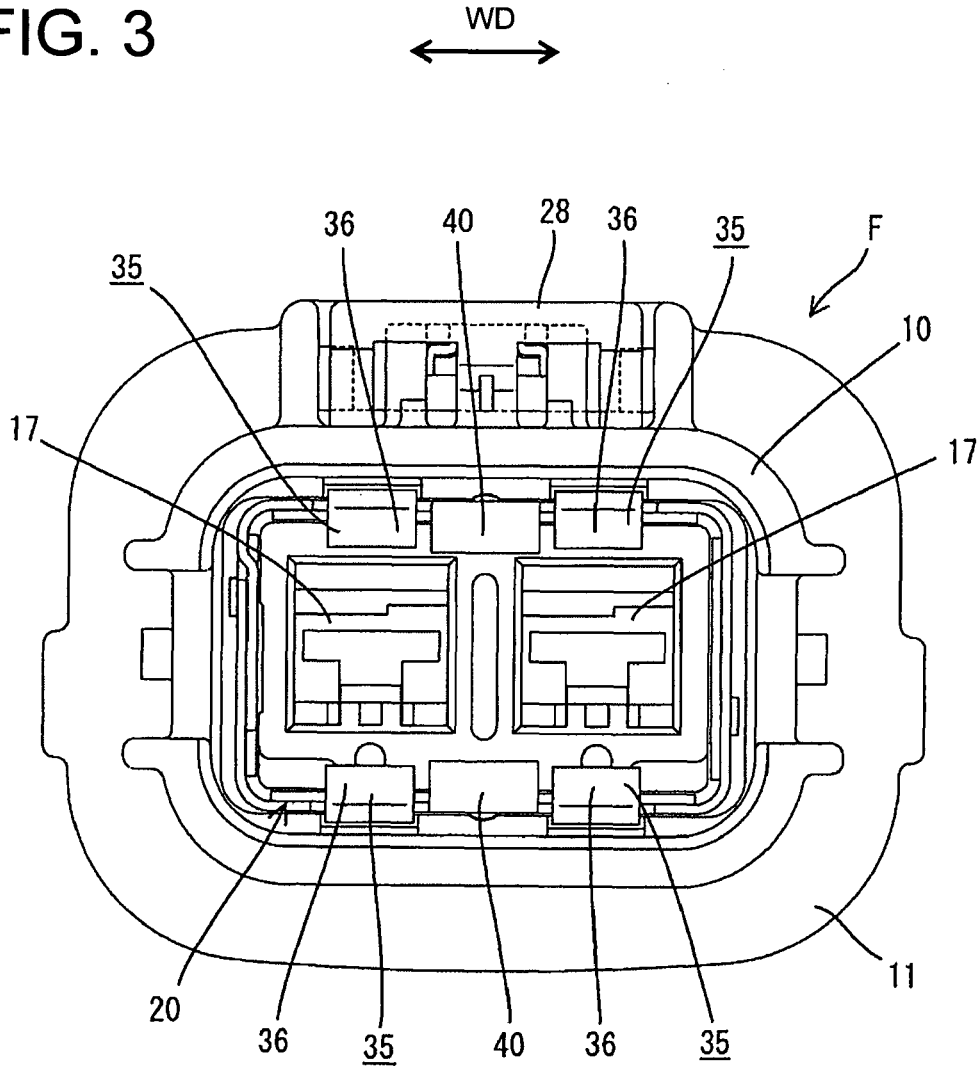
FIG. 3 is a rear view of the female connector in a state before shielded cables are inserted.

Male and female connectors according to a first embodiment of the invention are identified respectively by the letters M and F in FIGS. 1 to 6. Connection ends of the male and female connectors M and F along a connecting direction CD are referred to herein as the front ends.

The male connector M includes a housing 1 made e.g. of a synthetic resin. A terminal accommodating portion 2 is provided inside the housing 1 for accommodating male terminal fittings and a rectangular tubular receptacle 3 at least partly surrounding the terminal accommodating portion 2. A lock 4 projects in an intermediate part of the upper surface of the receptacle 3 near the opening edge, and is used to lock the connected state with a female connector F. Tabs 5 of male terminal fittings project forward from the back wall of the terminal accommodating portion 2. In this embodiment, two male terminal fittings are arranged side by side with a partition wall 6 interposed therebetween. A shielding shell 7 is fit on the outer peripheral surface of the terminal accommodating portion 2 for providing shielding for the male connector M. The shielding shell 7 is formed by bending, folding and/or embossing an electrically conductive metal plate into a substantially rectangular tube that extends along substantially the entire outer peripheral surface of the terminal accommodating portion 2 so that the front end of the shielding shell 7 projects forward from the front edge of the terminal accommodating portion 2 when the shielding shell 7 is assembled in the male connector housing 1.

The shielded female connector F includes a housing 8 made e.g. of a synthetic resin. The housing 8 is comprised of an inner tube 10 for accommodating female terminal fittings 9 and an outer tube 11 at least partly surrounding a front portion of the inner tube 10 from the outer side.

Each female terminal fitting 9 is made of an electrically conductive metal material. A terminal connecting portion 9*a* is formed at the front end of the female terminal fitting 9 and is configured to be connected with one of the tabs 5. A wire connection barrel 9*b* is formed rearward of the terminal connection portion 9*a* and is configured to be connected with the shielded cable 12. A core is arranged substantially in the center of the shielded cable 12, and has an inner sheath for insulation. A braided wire shield 13 and an outer coating are arranged substantially concentrically on the core in this order towards the outer side. The inner sheath is stripped off to expose the core near the end of the cable 12, and the wire connection barrel 9*a* of the female terminal fitting 9 is connected with this exposed part. The outer sheath is stripped off over a specified length immediately behind a part of the shielded cable 12 where the core is exposed, and the exposed braided wire shield 13 is turned up onto the outer sheath to expose the inner sheath. A conductive metal crimp ring 14 is connected with the turned-up part of the braided wire shield 13. A small diameter portion 14*a* is formed at a front end of the crimp ring 14, a large diameter portion 14*b* is formed at the rear end of the crimp ring 14 and a step is defined between the small and large diameter portions 14*a* and 14*b*. The crimp ring 14 is fixed by crimping the small diameter portion 14*a* into connection with the braided wire shield 13. Although not shown, a ring is fit inside the braided wire shield 13 as an underlay beforehand so that a crimping force is not absorbed by the resiliency of the outer sheath upon crimping the crimp ring 14.

Figure 4:
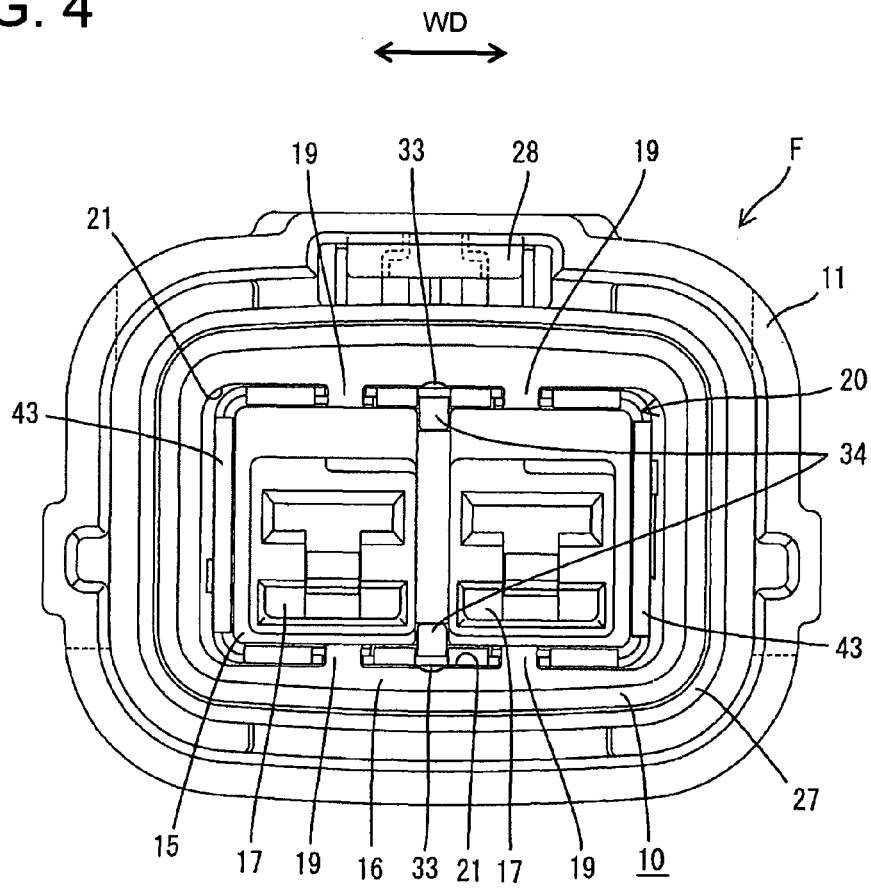
FIG. 4 is a front view of the female connector in the state of FIG. 3.

The inner tube 10 of the female housing 8 has an inner section 15 and an outer section 16. The inner section 15 is at the front of the inner tube 10 and accommodates the female terminal fittings 9. The outer section 16 is at the rear of the inner tube 10 and accommodates the connection of the shielded cable 12, the shielding shell 20 and preferably the fluid- or waterproofing. The inner section 15 is configured to fit in the terminal accommodating portion 2 of the male housing 1. Cavities 17 are formed substantially side by side in the inner section 15 for accommodating the female terminal fittings 9. Resiliently deformable locks 18 are formed in the cavities 17. The locks 18 engage the respective female terminal fittings 9 to retain the female terminal fittings 9 in the cavities 17. As shown in FIG. 4, the inner and outer sections 15 and 16 of the inner tube 10 are coupled substantially concentrically by upper and lower coupling pieces 19. Mount holes 21 penetrate the inner tube 10 in forward and backward directions FBD at positions between the inner and outer sections 15, 16 and adjacent to the coupling pieces 19. The mount holes 21 are configured to receive the shielding shell 20.

As described in detail later, a front side of the shielding shell 20 preferably is exposed on the outer surface of the inner section 15 and reaches up substantially to the front end of the inner section 15 with the shielding shell 20 assembled in the female housing 8. Further, a rear side of the shielding shell 20 extends substantially from the rear end of the inner section 15 substantially along the inner surface of the outer section 16 and reaches an intermediate position of the outer section 16.

A one-piece rubber plug 22 is to be mounted in the outer section 16 behind the shielding shell 20 and seals all of the shielded cables 12. Housing seal lips 23 project on the outer peripheral surface of the rubber plug 22 and sealingly engage the inner peripheral surface of the outer section 16. Wire insertion holes 24 penetrate the rubber plug 22, and accommodate shielded cables 12 connected with the female terminal fittings 9. Cable seal lips 25 are formed on the inner circumferential surfaces of the respective wire insertion holes 24 and sealingly engage the shielded cables 12. A plug holder 26 is fit into the outer section 16 behind the rubber plug 22 and retains the rubber plug 22. Through holes 42 penetrate through the plug holder 26 in conformity with the respective wire insertion holes 24 and receive the female terminal fittings 9 and the shielded cables 12.

A rubber ring 27 is fit on the outer surface of the outer section 16, and sealingly engages the inner peripheral surface of the receptacle 3 of the male housing 1 when the male and female housings 1, 8 are connected. Thus, the rubber ring 27 provides sealing between the housings 1, 8. A cutout is made in the upper wall of the outer tube 11 near the connection of the inner and outer tubes 10 and 11. A lock arm 28 is supported on the upper surface of the outer section 16 of the inner tube 10 by a connection 29 and. The lock arm 28 is exposed through the cutout and is resiliently deformable up and down like a seesaw about the connection 29. The lock arm 28 engages the lock projection 4 when the male and female housings 1, 8 are connected properly to hold the housings 1, 8 together.

The shielding shell 20 is formed by bending, folding and/or embossing an electrically conductive metal plate into a substantially rectangular tube. Slots 30 are cut in the upper and lower walls of the shielding shell 20 and extend lengthwise along the forward and backward directions FBD from the front edge of the shielding shell 20. The slots 30 are dimensioned and disposed to correspond to the coupling pieces 19 of the inner tube 10. The front portion of the shielding shell 20 is mountable from behind into the female housing 8. Thus, the slots 30 receive the coupling pieces 19. Portions of the shielding shell 20 between the slots 30 telescope through the mount holes 21 and onto the outer surface of the inner section 15. The shielding shell 20 is at least partly exposed while closely engaging the outer surface of the inner section 15 over substantially the entire periphery in a mounted state of the shielding shell 20. The part of the shielding shell 20 that is exposed on the inner section 15 is connectable with the inner side of the shielding shell 7 of the male connector 1 when the male and female housings 1, 8 are connected.

The entire front edge of the shielding shell 20, excluding the slots 30, is folded in to define folded-back portions 43 to facilitate mounting into the mount holes 21. A middle piece 31 is defined in each of the upper and lower walls of the shielding shell 20 between the slots 30 and a substantially U-shaped cut is made in each middle piece 31 to form a resiliently deformable tongue 32. A substantially semispherical contact 33 bulges out from the upper surface of the leading end of the tongue 32, and can resiliently contact the inner surface of the front end of the male shielding shell 7 when the male and female shielding shells 7, 20 are connected. Upper and lower locking claws 34 are formed in the middle pieces 31 of the shielding shell 20 behind the contacts 33 and extend obliquely in towards the back. The locking claws 34 are formed by making cuts in the shielding shell 20 and bending the cut portions. The locking claws 34 engage widthwise intermediate parts of the upper and lower surfaces of the inner section 15 when the shielding shell 20 is mounted at a proper position to prevent the shielding shell 20 from coming out backward.

Figure 5:
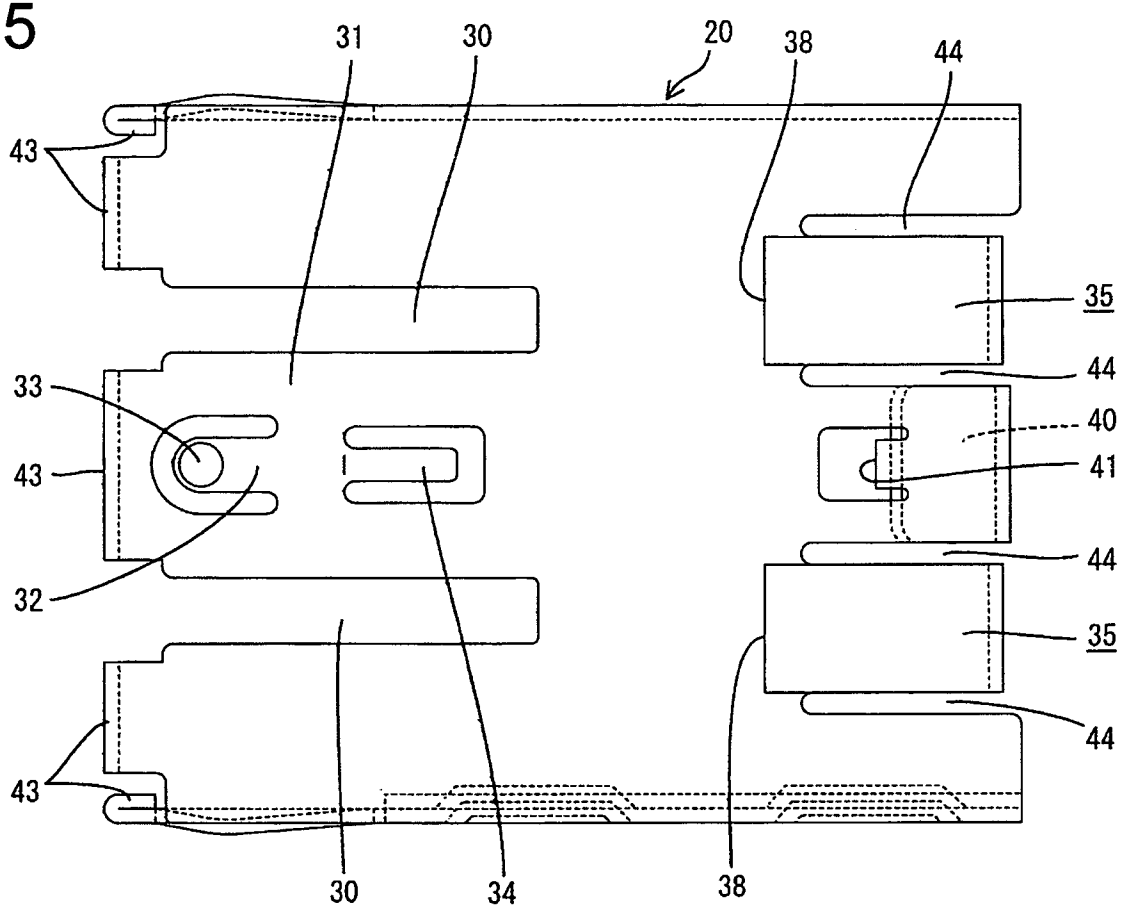
FIG. 5 is a plan view of a shielding shell.
Figure 6:
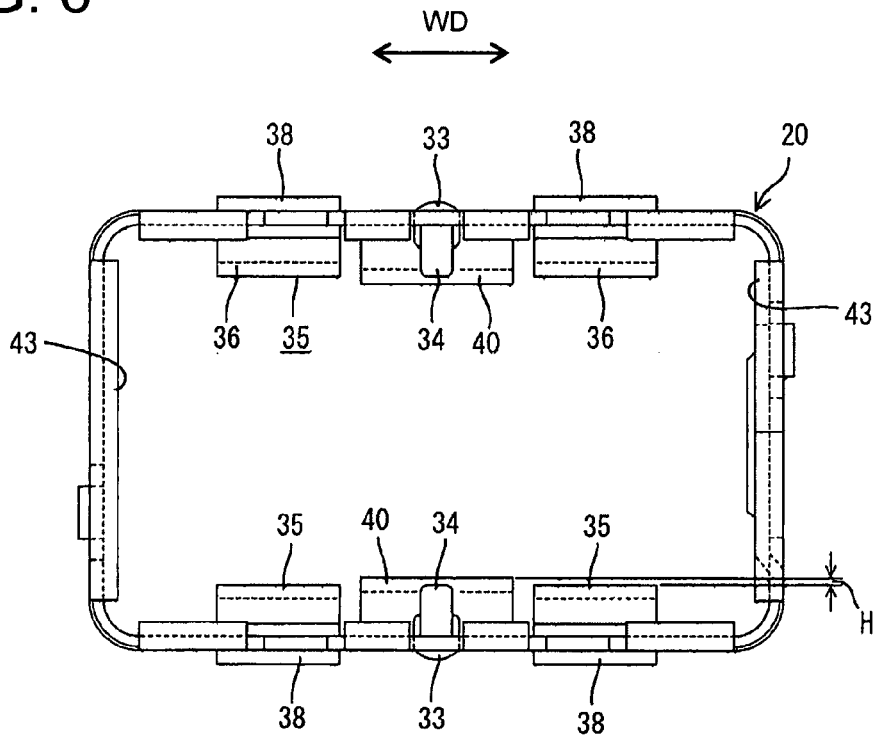
FIG. 6 is a front view of the shielding shell.
Figure 7:
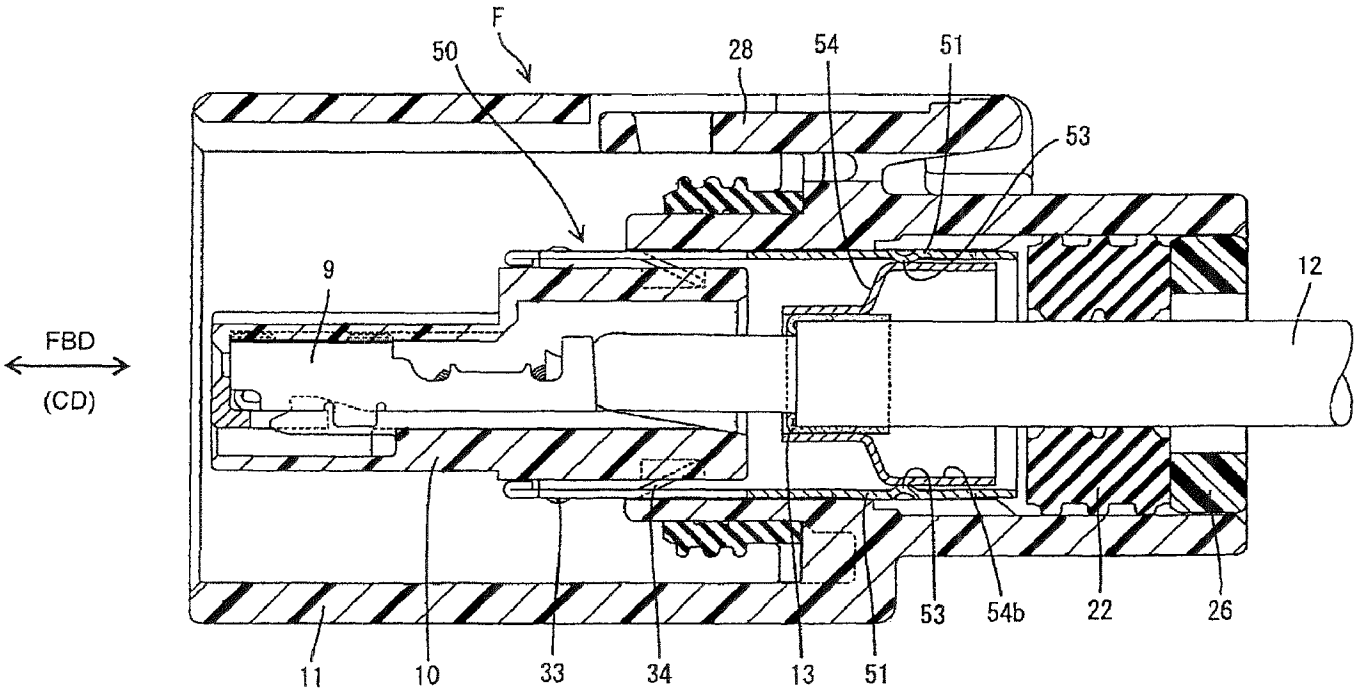
FIG. 7 is a section of a second embodiment of a female connector.
Figure 8:
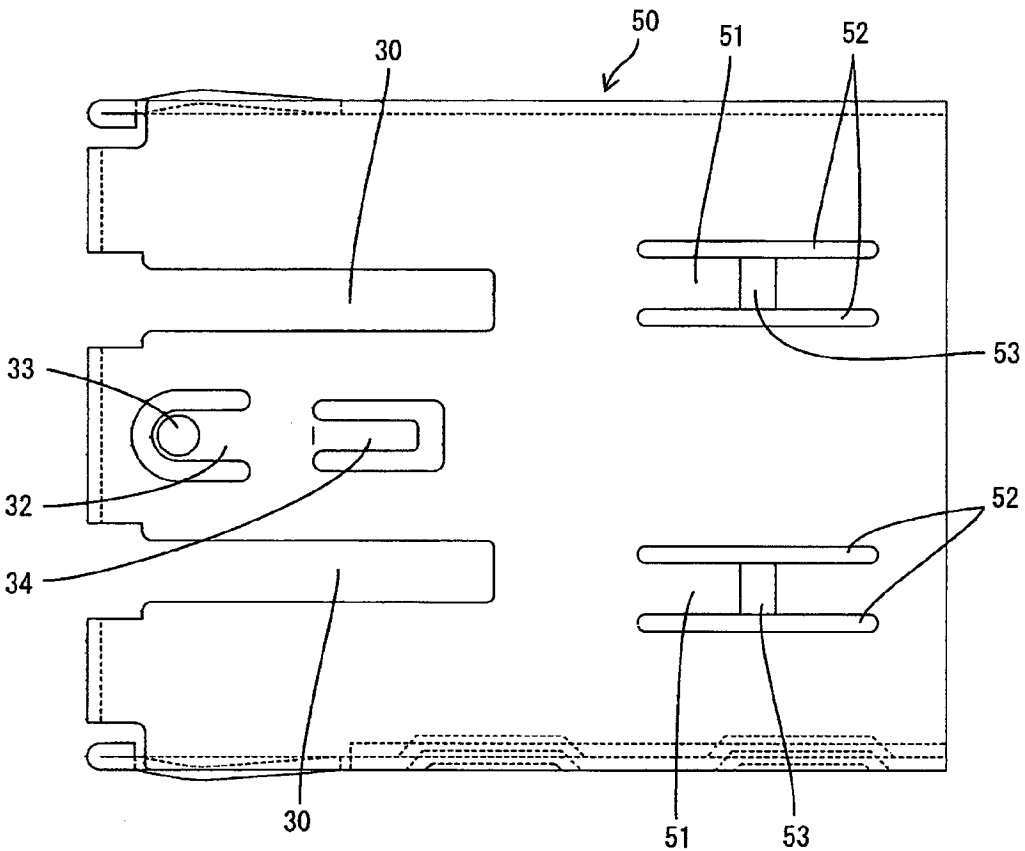
FIG. 8 is a plan view of a second embodiment of a shielding shell.
Figure 9:
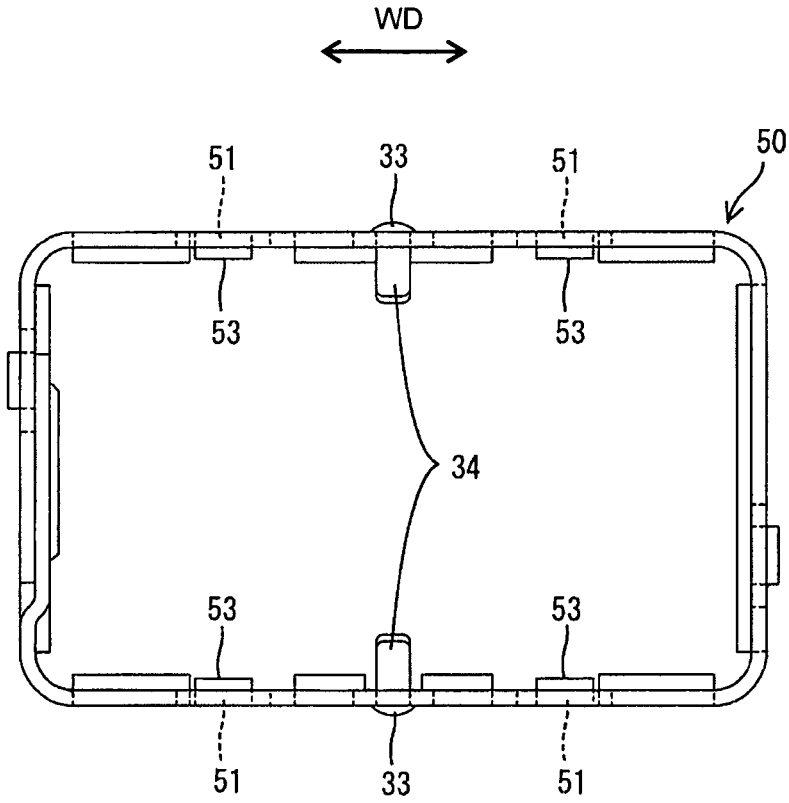
FIG. 9 is a rear view of the shielding shell.
Figure 10:
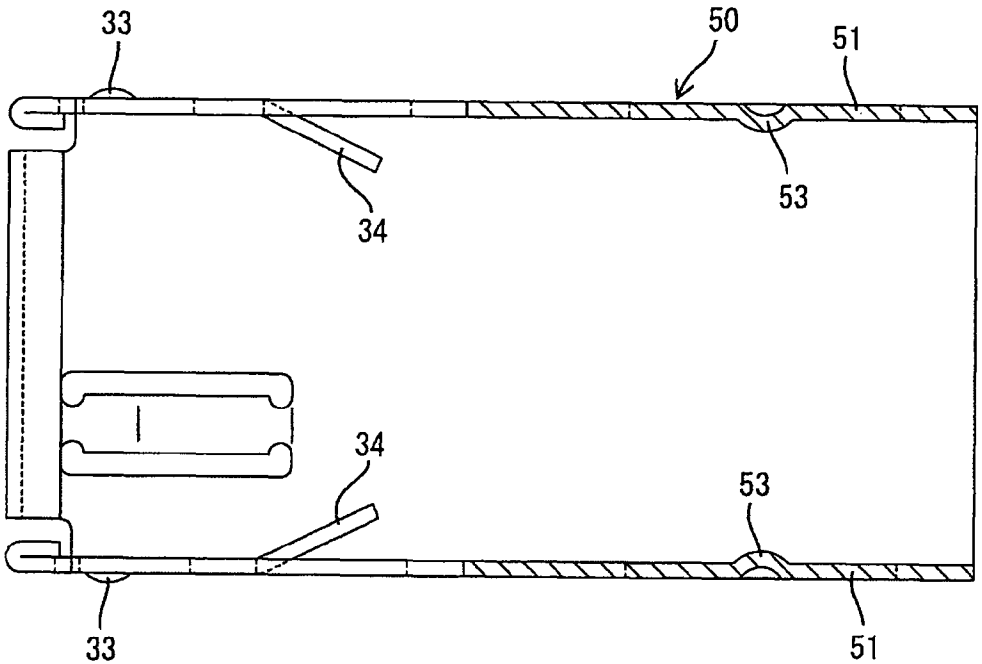
FIG. 10 is a section of the shielding shell.
Figure 11:
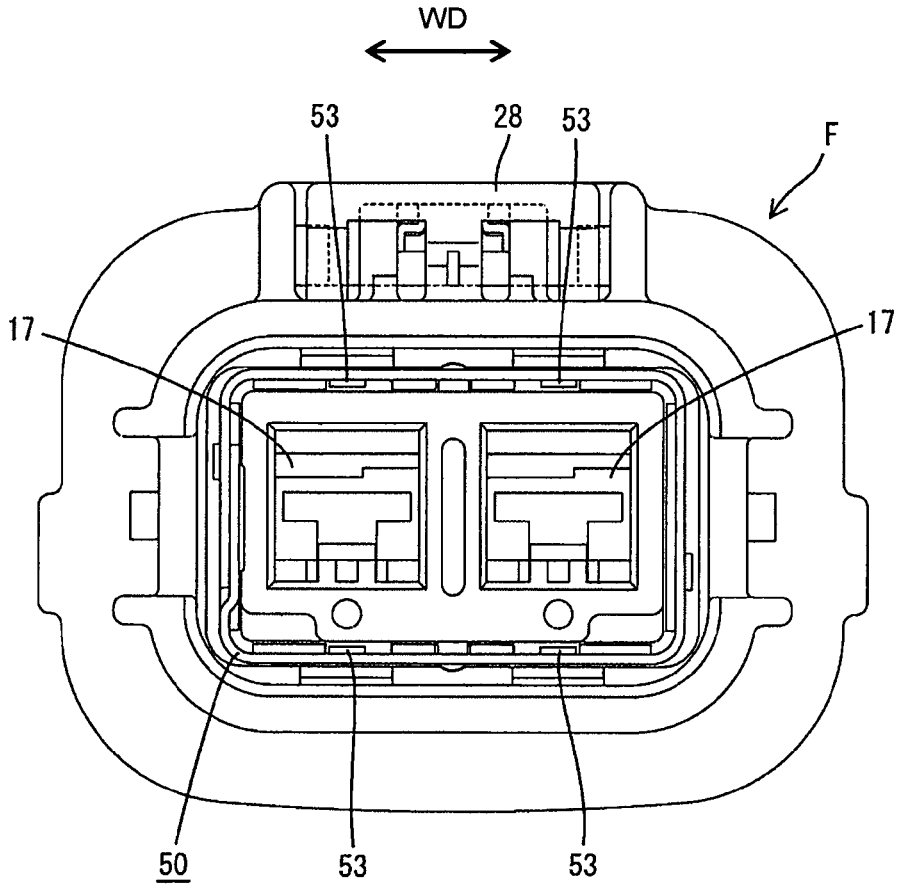
FIG. 11 is a rear view of the female connector.

Two touching portions 35 are formed in each of the upper and lower walls of the shielding shell 20 near the rear of the shielding shell 20. The touching portions 35 in each of the upper and lower walls are spaced apart in the width direction WD and are at positions to align with the shielded cables 12. As shown in FIG. 5, each of the touching portions 35 is formed between two cuts 44 and is at a position aligned with one of the slots 30 at the front of the shielding shell 20. Further, the respective touching portions 35 are retracted slightly inward so as not to project back from the rear edge of the shielding shell 20. Each of the touching portions 35 is bent inward of the outer section 16 to form mountain-shaped or pointed resilient contact pieces 36 and then is folded back out to extend substantially horizontally near the rear edge of the shielding shell 20.

The resilient contact pieces 36 are formed to resilient contact the outer peripheral surface of the large diameter portion 14*b* of the crimp ring 14 on each shielded cable 12. On the other hand, the inner surface of the outer section 16 is formed to have a slightly larger diameter in an area behind the front end of the touching portions 35. Thus, clearances 37 are defined between the touching portions 35 and the inner surface of the outer section 16 to permit suitable resilient deformations of the touching portions 35. Further, the leading edges of the respective touching portions 35 are bent or folded back out and are placed on the outer surface of the shielding shell 20. These leading edges define stops 38 that contact locking steps 39 formed in the inner surface of the outer section 16 to prevent any further forward movement of the shielding shell 20 when the shielding shell 20 is mounted.

Upper and lower displacement restricting portions 40 are formed on the upper or lower walls of the shielding shell 20 between the touching portions 35. The displacement restricting portions 40 protect the adjacent touching portion 35 from deformation caused by the terminal fitting 9, the crimp ring 14 or the like resulting from lateral shaking of the shielded cable 12 when the shielded cables 12 are accommodated into or withdrawn from the cavities 17.

Each displacement restricting portion 40 is formed by being folded or bent back and inward near the rear of the shielding shell 20 to have a mountain or pointed shape. The leading edge of each displacement restricting portion 40 contacts a stopper piece 41 formed by making a cut in the outer surface of the shielding shell 20 and bending the cut portion in at a substantially right angle. The displacement restricting portions 40 are between the shielded cables 12 and do not touch the crimp ring 14 when the shielded cables 12 are accommodated properly. Rather, the displacement restricting portions 40 contact the crimp ring 14 only upon an off-center displacement of the shielded cable 12 during the insertion or withdrawal of the shielded cable 12 as described above. Further, the peak of each displacement restricting portion 40 is more inward than the peaks of the two adjacent touching portions 35 (height difference H in FIG. 6), and is set to conceal the touching portion 35 at one lateral side from the opposite lateral side.

The terminal fitting 9 of the shielded cable 12 having the crimp ring 14 mounted thereon is aligned substantially with the wire insertion hole 24 of the rubber plug 22 and is pushed in this state so that the terminal fitting 9 enters the outer section 16 while forcibly widening the wire insertion hole 24. The terminal fitting 9 might be displaced in the width direction WD from the corresponding upper and lower touching portions 35 while the terminal fitting 9 is being inserted into the outer section 16. However, the displaced terminal fitting 9 will contact the displacement restricting portions 40 and will avoid interference with the touching portion 35 that is adjacent in the width direction. Leading ends of the displacement restricting portions 40 contact the stopper pieces 41 and hence the displacement restricting portions 40 reliably retain their shapes. Thus, the displacement restricting portions 40 will prevent any further pushing movement of any misaligned terminal fitting 9. In this way, an operator receives a strong resistance if the terminal fitting 9 contacts the displacement restricting portions 40. The operator, therefore, is aware of the occurrence of the off-center displacement and corrects an operating direction.

The lock 18 locks the terminal fitting 9 when the terminal fitting 9 reaches a proper depth in the corresponding cavity 17. Simultaneously, the resilient contact pieces 36 of the touching portions 35 contact the outer surface of the large diameter portion 14*b* of the respective crimp ring 14 and are resiliently deformed by the resulting push-up forces. Accordingly, the resilient contact pieces 36 are held reliably in contact with the crimp ring 14 by their resilient reaction forces. An error in mounting or producing the shielding shell 20 and shielded cables 12 might occur. However, the contact of the shielding shell 20 and the crimp ring 14 is accompanied by resilient displacements of the resilient contact pieces 36. Thus, such a mounting or production error can be absorbed reliably to obtain a good contact state. The above-described operation is performed for the other shielded cable 12 to complete assembly of the female housing 8.

The receptacle 3 of the male housing 1 is aligned with the outer tube 11 of the female housing 8 and is fit therein. The lock arm 28 engages the lock projection 4 when the receptacle 3 is fit to a proper depth and holds the male and female housings 1, 8 connected. The inner tube 10 is fit into the terminal accommodating portion 2 as the housings 1, 8 are connected and simultaneously the male and female shielding shells 7, 20 are connected. In this way, the contact portions 33 of the female shielding shell 20 are held in contact with the inner surface of the male shielding shell 7 with resilient forces. Further, the male and female terminal fittings simultaneously connect with each other.

As described above, the touching portions 35 are formed within the length of the shielding shell 20 and do not project out. Thus, the touching portions 35 are protected from deformation caused by contact with external matter. Further, the touching portions 35 are folded back and out and their end edges to define the stopper edges 38 that prevent any further forward movement of the shielding shell 20 when the shielding shell 20 is mounted into the housing 8. Therefore, the mount position of the shielding shell 20 can be specified to a proper position. The shielded cable 12 could be displaced laterally upon inserting or withdrawing the shielded cable 12 into or from the cavity 17. However, the terminal fitting 9 contacts the displacement restricting portions 40 and will not interfere with the touching portions 35 behind the displacement restricting portions 40. Thus, the touching portions 35 are protected from deformations. The peaks of the displacement restricting portions 40 are more inward than the peaks of the touching portions 35. Thus, the touching portions 35 are protected.

A second embodiment of the invention is described with reference to FIGS. 7 to 11. This embodiment differs from the first embodiment in the construction of the shielding shell of the female connector F and the crimp ring. Elements of the second embodiment that are similar to the first embodiment are identified by the same reference numerals, but are not described again.

The shielding shell of the second embodiment is identified by the numeral 50 and differs from the first embodiment primarily with respect to the touching portions 51. Two pairs of touching portions 51 are arranged substantially vertically symmetrically in the upper and lower walls of the shielding shell 50. Each touching portion 51 is formed between two slits 52 that are spaced apart in the width direction WD, and is resiliently deformable along the thickness direction. In other words, the touching portions 51 of this embodiment are formed to be substantially flush with the shielding shell 50. Lengthwise intermediate parts of the touching portions 51 are embossed over their entire widths to project in and to form contacts 53 for contacting large diameter portions 54*b* of crimp rings 54.

On the other hand, the large diameter portion 54*b* of the crimp ring 54 mounted on a braided wire shield 13 of each shielded cable 12 is formed with a large diameter as to substantially reach and push the upper and lower surfaces of the shielding shell 50.

The second embodiment has the functions and effects of the first embodiment. Additionally, the touching portions 51 do not project in or out, except the contact portions 53 that project only slightly in. Hence, a chance of being damaged by an external force is reduced even as compared to the first embodiment. Accordingly, the displacement restricting portions 40 of the first embodiment are not needed. Further, the touching portions 51 of the shielding shell 50 are formed merely by punching without necessitating the folding, and there is an additional effect of good blank cutout.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Although the crimp ring 14 is mounted on the shielded cable 12 and serves as the shielding portion in the first embodiment, the shield layer may directly contact with the shielding shell 20 as a shielding portion.

The displacement restricting portions 40 are formed separately from the touching portions 35 in the first embodiment. However, they may be formed integrally with the touching portions 35.

The displacement restricting portions 40 assure that the touching portions 35 are not deformed by a shielded cable 12 that is off-center during the insertion or withdrawal. However, the displacement restricting portions may be provided in the housing. In such a case, the displacement restricting portions 40 are, for example, in the form of ribs projecting from the inner surface of the outer section 16 between the adjacent touching portions 35. In such a construction, resin portions having a long projecting distance are formed, and might be damaged due to insufficient strength. In this respect, there is at least no concern about strength if the displacement restricting portions 40 are formed by the metal material of the shielding shell 20 as in the first embodiment.

Although one pair of upper and lower touching portions 35, 51 are provided for each shielded cable 12 in the both embodiments, the touching portions 35, 51 may be provided only at the upper side or at the lower side.

What is claimed is:

1. A shielded connector, comprising:

at least one terminal fitting to be connected with an end of a core of a shielded cable, a housing for accommodating the terminal fitting, and a shielding shell mounted to the housing for contacting a shielding portion of the shielded cable, wherein the shielding shell is formed into a tubular shape at least partly surrounding an outer side of the shielding portion and formed with at least one touching portion that can resiliently contact the shielding portion, the touching portion being provided within the length of the tubular part of the shielding shell without projecting lengthwise from an end edge of the shielding shell, the touching portion being formed by making at least two cuts along a length direction from the end edge of the shielding shell, a strip being defined between the two cuts and projecting inward of the shielding shell for resiliently contacting the shielding portion, the strip being folded back and outward near the end edge of the shielding shell and a stopper edge being formed at the folded end of the touching portion for contacting at least one locking step on the housing when the shielding shell is mounted to the housing for preventing further movement of the shielding shell.

2. A shielded connector, comprising:

at least one terminal fitting to be connected with an end of a core of a shielded cable, a housing for accommodating the terminal fitting, and a shielding shell mounted to the housing for contacting a shielding portion of the shielded cable, wherein the shielding shell is formed into a tubular shape at least partly surrounding an outer side of the shielding portion and formed with at least one touching portion that can resiliently contact the shielding portion, the touching portion being provided within the length of the tubular part of the shielding shell without projecting lengthwise from an end edge of the shielding shell, and wherein at least one displacement restricting portion projects from at least one of the shielding shell and the housing for restricting an off-center displacement of the shielded cable by having the leading end thereof located at a lateral side of the shielding portion of the shielded cable.

3. The shielded connector of claim 2, wherein the touching portion is formed by making at least two cuts along a length direction from the end edge of the shielding shell.

4. The shielded connector of claim 3, wherein a strip between the two cuts project inward of the shielding shell for resiliently contacting the shielding portion and being folded back outward near the end edge of the shielding shell.

5. The shielded connector of claim 1, wherein the shielding portion is formed by a crimp ring fastened to a shield layer exposed from the shielded cable and having a portion with a larger diameter than the shielded cable.

6. The shielded connector of claim 5, wherein the touching portion is formed by at least two slits along a lengthwise direction in a lengthwise intermediate part of the shielding shell for resiliently contacting the crimp ring with a part the strip between the two slits held substantially flush with the outer surface of the shielding shell.

7. The shielded connector of claim 4, wherein a stopper edge is formed at the folded end of the touching portion for contacting at least one locking step on the housing when the shielding shell is mounted to the housing for preventing further movement of the shielding shell.

* * * * *